United States Patent [19]

Hosono et al.

[11] Patent Number: 4,734,692

[45] Date of Patent: Mar. 29, 1988

[54] DRIVER CIRCUIT FOR LIQUID CRYSTAL DISPLAY

[75] Inventors: Masaki Hosono, Fujisawa; Yukio Nemoto, Kanagawa, both of Japan

[73] Assignee: Matsushita Electric Industrial Co., Ltd., Osaka, Japan

[21] Appl. No.: 855,458

[22] Filed: Apr. 24, 1986

[30] Foreign Application Priority Data

Apr. 26, 1985 [JP] Japan ..... 60-90006
Apr. 26, 1985 [JP] Japan ..... 60-90008

[51] Int. Cl.[4] ..... G09G 3/36

[52] U.S. Cl. ..... 340/789; 340/784; 340/805

[58] Field of Search ..... 340/784, 805, 789

[56] References Cited

U.S. PATENT DOCUMENTS

| | | | |
|---|---|---|---|
| 4,100,579 | 7/1978 | Ernstoff | 340/784 |
| 4,395,708 | 7/1983 | Lloyd | 340/784 |
| 4,477,805 | 10/1984 | Arton et al. | 340/784 |
| 4,525,710 | 6/1985 | Hoshi et al. | 340/784 |
| 4,626,841 | 12/1986 | Togashi | 340/805 |

*Primary Examiner*—Howard A. Birmiel
*Attorney, Agent, or Firm*—Spencer & Frank

[57] ABSTRACT

A driver circuit for a liquid crystal display for driving a liquid crystal panel in an A.C. manner. In this circuit, a display signal voltage to be applied to one electrode of the liquid crystal cell and a common voltage to be applied to a common electrode thereof are inverted in their polarity with a certain period, respectively, and at least one of the signal voltage and common voltage that are being polarity-inverted with the certain period is varied in its D.C. level by the same amount in the same direction in each period so that they can be adjusted so as to be in a predetermined relation for A.C. driving.

4 Claims, 6 Drawing Figures

DRIVER CIRCUIT FOR LIQUID CRYSTAL DISPLAY

BACKGROUND OF THE INVENTION

1. FIELD OF THE INVENTION

This invention relates to a driver circuit for a liquid crystal display that can be employed in a liquid crystal television receiver or the like.

2. DESCRIPTION OF THE PRIOR ART

In recent years, pocket-sized liquid crystal television receivers have been available. In such a liquid crystal television receiver, each of switching elements comprising FET's provided at respective elemental liquid crystal cells arranged in a matrix shape on a liquid crystal panel is supplied with an input image signal voltage and a switching signal and is connected with one electrode of each liquid crystal cell. A common electrode commonly connected with the opposite electrode of each liquid crystal cell is supplied with a common voltage. Since the liquid crystal panel must be A.C. driven, the input signal voltage and common voltage are inverted in their polarity every one field.

Referring now to the drawings, an example of the prior art driver circuit for liquid crystal displays will be explained below.

In FIG. 1 showing a matrix type liquid crystal display, a liquid crystal cell 1, storage capacitor 2 and field effect transistor (FET) 3 that serves as a switching element constitute a liquid crystal display element for displaying each picture element (pixel). An X-electrode 4 is supplied with a switching signal and a Y-electrode 5 is supplied with an image signal. A common electrode 6 provided on an opposite substrate is supplied with a common voltage.

In FIG. 2 showing one display element in detail, 1 to 6 denote like parts in FIGS. 1 and 7, 8 and 9 denote capacitances $C_{GS}$, $C_{GD}$ and $C_{DS}$ among the electrodes of the FET, respectively. Y-electrode 5 is supplied with an image signal that is inverted in its polarity every one field as shown by 10 in FIG. 3 and sampled by each switching element for each pixel. Common electrode 6 is supplied with a common voltage that is inverted in its polarity every one field as shown by 11 in FIG. 3. The image signal voltage is applied to one electrode of the liquid crystal cell 1 when FET 3 is turned on by the switching signal applied to X-electrode 4. This switching signal turns on FET 3 during 1H (H denotes a horizontal scanning period: 63.5 μsec. and turns it off during the remaining about one-field period (16.7 m sec.). Storage capacitor 2 holds during the "off" period a charge corresponding to the image signal voltage applied during the "on" period. The drive voltage applied across the liquid crystal cell 1 is inverted in its polarity during the subsequent one field, for A.C. drive of the liquid crystal panel.

FIG. 4 shows a circuit for inverting the image signal and the common voltage. In FIG. 4, 12 denotes an input terminal of a switching signal $V_T$ that is changed into a high/low level every one field. This $V_T$ signal is employed to switch, every one field, inverter circuits 14 and 15 to alternately derive, the image signal applied to an image input terminal 13 and its polarity-inverted image signal, and to alternately derive a common voltage $V_1$ obtained by dividing a power voltage $V_{cc}$ by resistances $R_1$, $R_2$ and $R_3$ and its polarity-inverted voltage $V_2$. Namely, the image signal is inverted in its polarity every one field and sent to an image output terminal 16. This polarity-inverted image signal is applied to Y-electrode 5 of FIG. 2 through a Y-driver. The $V_1$ and $V_2$ voltages, polarity-inverted every one field, are sent to a common voltage terminal 17 and applied to common electrode 6 of FIG. 2.

The above mentioned prior art arrangement suffers from the following disadvantages.

Since, as shown in FIG. 2, inter-electrode capacitances $C_{GS}$ 7, $C_{GD}$ 8 and $C_{SD}$ 9 exist among the electrodes of FET 3, and also the capacitance of storage capacitor 2 may vary because of the fabrication process of the liquid crystal panel, the image signal voltage and the common voltage applied to an electrode of a liquid crystal cell may not be correctly related. More specifically, although the polarity-inverted voltage must be applied across a liquid crystal cell with a predetermined voltage difference every one field, the level of image signal voltage 10 may vary at one electrode of the liquid crystal cell because of the above variation as shown, for example, by the one-dotted chain line in FIG. 3. Thus, the applied voltage may be partially inverted as shown by the dotted arrow in FIG. 3 or the difference between the image signal voltage and the common voltage (i.e. the amplitude of the voltage applied across the liquid crystal cell) may fluctuate among the respective fields.

SUMMARY OF THE INVENTION

An object of this invention is to provide a driver circuit for a liquid crystal display which can be easily adjusted for adjusting an image signal and a common voltage to be in a predetermined relation.

To attain this object, in accordance with this invention, there is provided a driver circuit for a liquid crystal display that A.C.-drives a liquid crystal panel, wherein a display signal voltage to be applied to one electrode of each liquid crystal cell and a common voltage to be applied to a common electrode thereof are inverted in their polarity with a given constant period, respectively, and at least one of the signal voltage and common voltage polarity-inverted with the constant period is varied in its D.C. level by the same amount in the same direction in each period so that they can be adjusted so as to be in a predetermined relation for A.C. driving.

In this way, where the relation between the signal voltage and common voltage deviates from a predetermined relation as in the prior art arrangement, they can be correctly adjusted so as to be in the predetermined relation by varying at least the D.C. level of one of them. Thus, the liquid crystal panel can be correctly A.C.-driven so that its performance will be greatly improved and its life will be lengthened.

The above and other objects, features and advantages of this invention will be more clearly understood from the following description taken in conjunction with the accompanying drawings.

DESCRIPTION OF THE PREFERRED EMBODIMENTS

Figure 5:
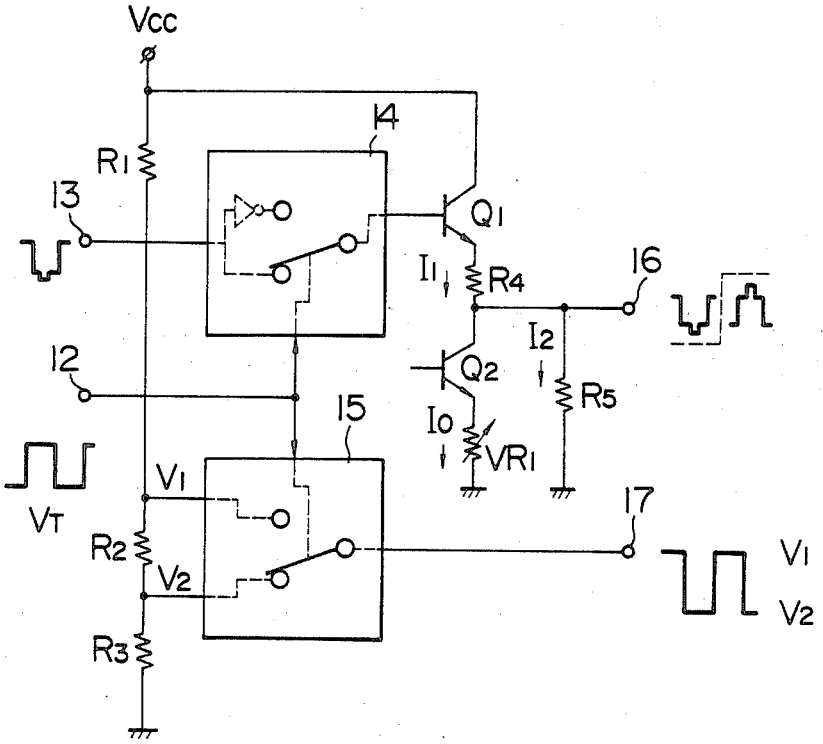
FIG. 5 is a circuit diagram of a driver circuit for a liquid crystal display according to one embodiment of this invention.

In FIG. 5 showing one embodiment of a driver circuit for a liquid crystal display, 12 denotes an input terminal of a switching signal $V_T$ that is changed into a high/low level every one field. This $V_T$ signal is employed to alternately derive the image signal applied to an image input terminal 13 and its polarity-inverted image signal, and alternately derive a common voltage $V_1$ obtained by resistances $R_1$, $R_2$ and $R_3$ and its polarity-inverted voltage $V_2$, by switching inverter circuits 14 and 15 every one field respectively. The image signal polarity-inverted by inverter circuit 14 is driven by means of an emitter follower of a transistor $Q_1$ and is connected through a resistor $R_4$ with a constant current source composed of a transistor $Q_2$ and a variable resistor $VR_1$. By varying the current of the constant current source by the variable resistor $VR_1$, the D.C. level of the image signal can be varied by the same amount in the same direction in each field. Namely, assuming that $I_1$ is the D.C. component of the emitter current of transistor $Q_1$, $I_0$ is the emitter current (D.C. current) of transistor $Q_2$, $I_2$ is the D.C. component of the current flowing through a resistor $R_5$, $V_0$ is the D.C. level voltage at an image output terminal 16 and $V_{E1}$ is the D.C. component of the emitter voltage of transistor $Q_1$, $$V_0 = (V_{E1} - R_4 I_0) \times \frac{R_5}{R_4 + R_5} \quad (1)$$

Therefore, by varying the current $I_0$ from the constant current source, the D.C. level of the polarity-inverted image signal can be varied by the same amount in the same direction in each field.

Figure 1:
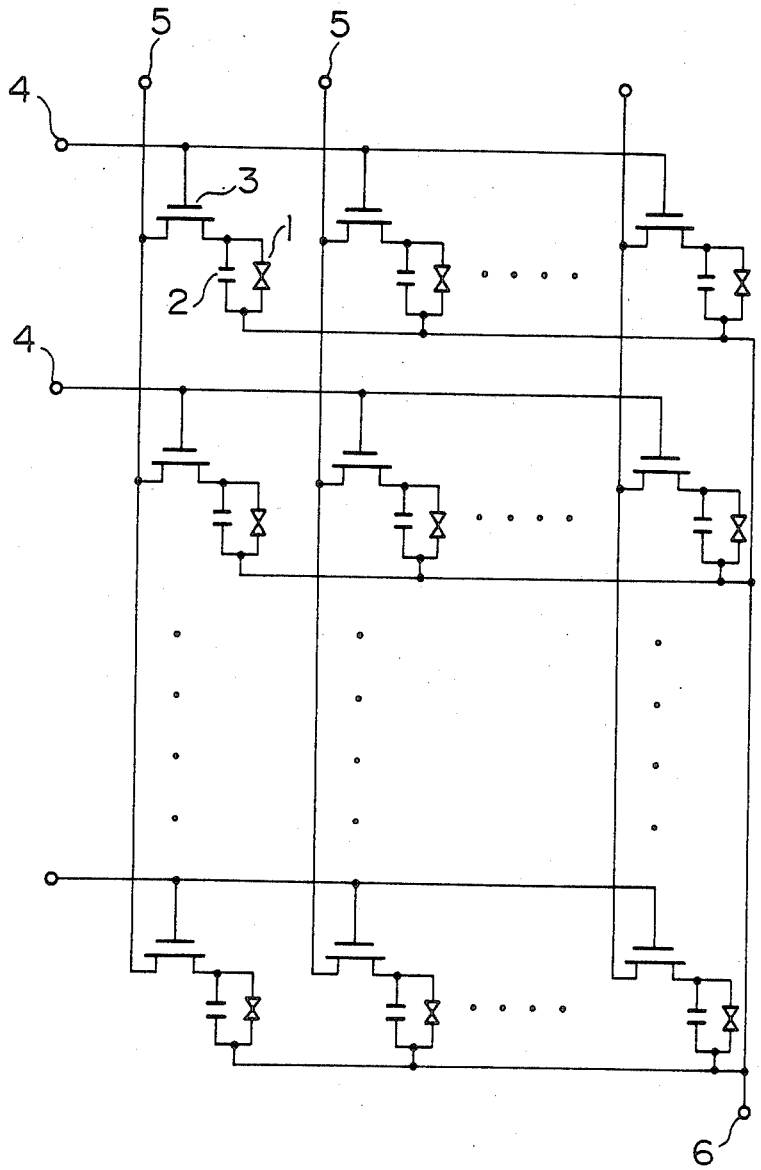
FIG. 1 PRIOR ART
FIG. 1 shows a schematic arrangement of a matrix type liquid crystal display.
Figure 2:
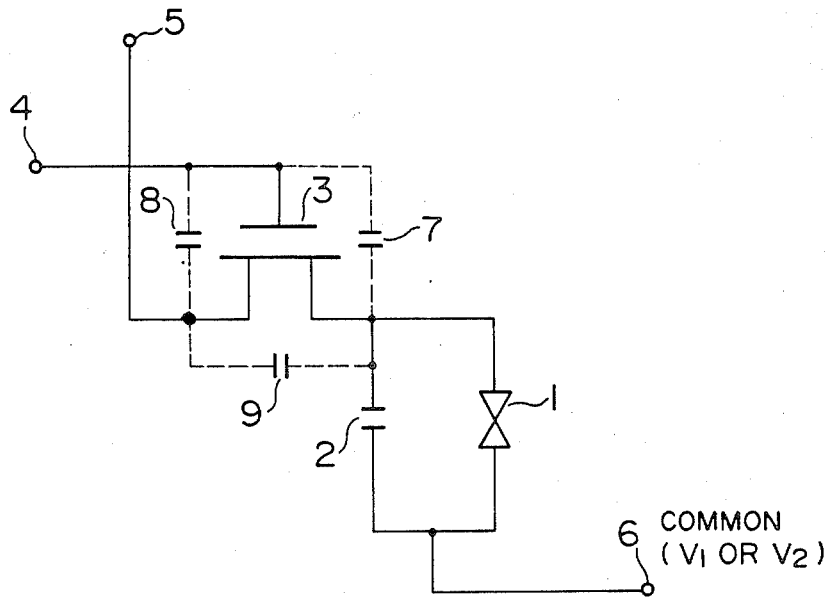
FIG. 2 PRIOR ART
FIG. 2 shows a schematic arrangement of one liquid crystal display element for displaying each picture element in the matrix type liquid crystal display.
Figure 3:
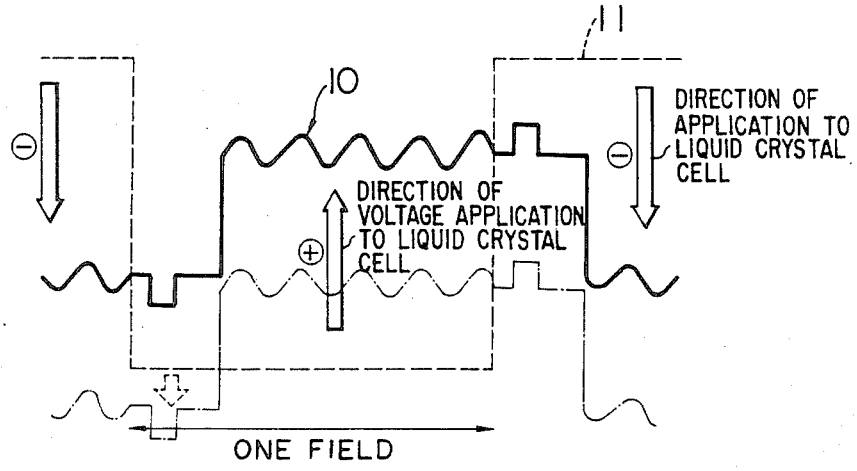
FIG. 3 PRIOR ART
FIG. 3 is a waveform chart of voltages applied to one electrode of a liquid crystal cell.
Figure 4:
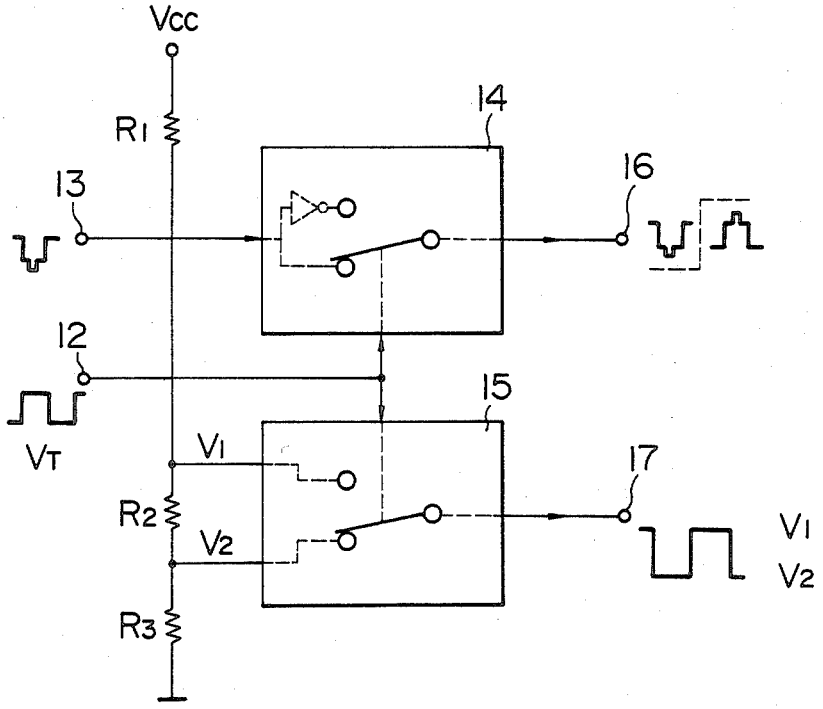
FIG. 4 PRIOR ART
FIG. 4 is a circuit diagram of a driver circuit for the prior art liquid crystal display.

In this way, in accordance with this embodiment, in the case where the D.C. level of the polarity inverted image signal to be applied to one electrode of a liquid crystal cell is reduced as shown, for example, by the one-dotted chain line in FIG. 3, the D.C. level of the output image signal can be elevated to a predetermined level as shown by the image signal 10 of the solid line in FIG. 3 by controlling the D.C. current flowing through transistor $Q_2$ of the constant current source so as to be decreased, thereby permitting the liquid crystal cell to be A.C. driven in a predetermined voltage relation.

Figure 6:
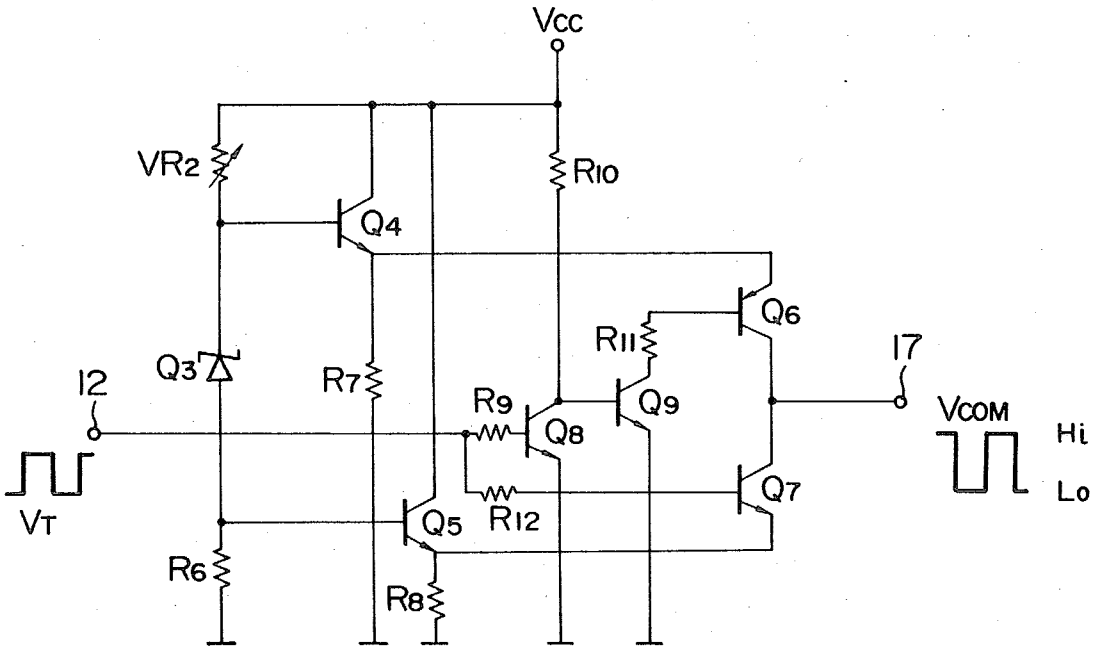
FIG. 6 is a circuit diagram of a driver circuit for a liquid crystal display according to another embodiment of this invention.

Another embodiment of this invention will be explained with reference to FIG. 6. In FIG. 6, 12 denotes an input terminal of a $V_T$ signal that is changed into a high/low level every one field and 17 denotes a common voltage output terminal. The voltages at the ends of a constant voltage device $Q_3$ are applied to the emitters of transistors $Q_6$, $Q_7$ through the emitter followers of transistors $Q_4$, $Q_5$, respectively. When the level of the $V_T$ signal is high, transistor $Q_7$ is turned on so that the voltage at common voltage output terminal 17 is at a low level $V_{COM(Lo)}$. On the other hand, when the level of the $V_T$ signal is low, a transistor $Q_8$ is turned off and transistors $Q_9$, $Q_6$ are turned on so that the voltage at common voltage output terminal 17 is at a high level $V_{COM(Hi)}$. Assuming that the voltage difference across constant voltage device $Q_3$ is $V_{Q3}$, the base-emitter voltage of each transistor is $V_{BE}$ and the saturation voltage of each transistor is $V_{CE}$(sat), $$V_{COM(Lo)} = (V_{CC} - V_{Q3}) \times \frac{R_6}{VR_2 + R_6} - V_{BEQ5} + V_{CE(sat)Q7} \quad (2)$$

$$V_{COM(Hi)} = (V_{CC} - V_{Q3}) \times \frac{R_6}{VR_2 + R_6} + V_{Q3} - V_{BEQ4} - V_{CE(sat)Q6} \quad (3)$$

Therefore, by varying the value of $V_{R2}$, the D.C. level of the common voltage can be adjusted with the difference between its both levels being maintained constant.

In this way, in accordance with this embodiment, the common voltage can be varied with the difference between its both levels being maintained constant so that the relation between the image signal and the common voltage can be always correctly adjusted. For example, in the case where the image signal level is deviated to a low value with respect to the common voltage as shown by the one-dotted chain line in FIG. 3, the D.C. level of the common voltage can be reduced to a predetermined level by controlling the variable resistor $VR_2$ so as to be increased, thereby permitting the liquid crystal cell to be A.C. driven in a predetermined voltage relation.

What is claimed is:

1. A driver circuit for A.C. driving a liquid crystal display cell, comprising:

polarity inversion means for polarity-inverting, with a given period, a display signal voltage to be applied to one electrode of the liquid crystal display cell and a common voltage to be applied to an opposite common electrode thereof, respectively; and D.C. level shifting means for varying the D.C. voltage level of at least one of the signal voltage and common voltage polarity-inverted with said given period by the same amount in the same direction in each period, said D.C. level shifting means comprising a first transistor for receiving the polarity inverted signal voltage, a series circuit comprising first and second resistors connected with the emitter of said first transistor, a signal voltage output terminal provided at the connection point of said first and second resistors and a constant current source with its current value being adjustable, connected in parallel to said second resistor.

2. A driver circuit according to claim 1, wherein said constant current source includes a series circuit comprising a second transistor and a variable resistor.

3. A driver circuit for A.C. driving a liquid crystal display cell, comprising:

polarity inversion means for polarity-inverting, with a given period, a display signal voltage to be applied to one electrode of the liquid crystal display cell and a common voltage to be applied to an opposite common electrode thereof, respectively, said polarity inversion means for inverting said common voltage comprising a constant voltage device, having first and second ends, and switching means for alternately outputting first and second voltages provided at the first and second ends of said constant voltage device; and D.C. level shifting means for varying the D.C. voltage level of at least one of the signal voltage and common voltage polarity-inverted with said given period by the same amount in the same direction in each period.

4. A driver circuit according to claim 3, wherein said D.C. level shifting means comprises means for varying the voltage applied to said constant voltage device.

* * * * *